US005552872A

United States Patent [19]

Amemiya et al.

[11] Patent Number: 5,552,872

[45] Date of Patent: Sep. 3, 1996

[54] SEPARATION CHARGER CONTROL FOR ELECTRO-PHOTOGRAPHIC APPARATUS

[75] Inventors: Koji Amemiya, Tokyo; Masahiro Inoue, Yokohama, both of Japan

[73] Assignee: Canon Kabushiki Kaisha, Tokyo, Japan

[21] Appl. No.: 186,036

[22] Filed: Jan. 25, 1994

Related U.S. Application Data

[62] Division of Ser. No. 182,515, Jan. 14, 1994, which is a continuation of Ser. No. 963,262, Oct. 19, 1992, abandoned, which is a continuation of Ser. No. 531,154, May 31, 1991, abandoned.

[30] Foreign Application Priority Data

| | | | |
|---|---|---|---|
| May 31, 1989 | [JP] | Japan | 1-138189 |
| May 31, 1989 | [JP] | Japan | 1-138779 |
| Aug. 30, 1989 | [JP] | Japan | 1-223695 |

[51] Int. Cl.[6] ..... G03G 15/14; G03G 15/16

[52] U.S. Cl. ..... 355/274; 355/271; 355/272; 355/273; 361/225; 361/230; 361/214

[58] Field of Search ..... 355/271–274, 355/276, 215; 361/214, 225

[56] References Cited

U.S. PATENT DOCUMENTS

| | | | |
|---|---|---|---|
| 3,729,311 | 4/1973 | Langdon | 96/1.2 |
| 3,877,416 | 4/1975 | Donohue et al. | 118/637 |
| 3,915,874 | 10/1975 | Machida | 252/62.1 |
| 4,134,147 | 1/1979 | Watanabe | 361/235 |
| 4,162,843 | 7/1979 | Inoue et al. | 355/327 |
| 4,165,165 | 8/1979 | Iwami et al. | 355/327 |
| 4,676,627 | 6/1987 | Ohno | 355/221 |
| 4,737,816 | 4/1988 | Inoue et al. | 355/315 |
| 4,766,463 | 8/1988 | Wantanuki et al. | 355/272 |
| 4,771,318 | 9/1988 | Noguchi et al. | 355/315 |
| 4,816,871 | 3/1989 | Oushiden et al. | 355/3 |
| 4,875,069 | 10/1989 | Takada et al. | 355/271 |
| 4,912,515 | 3/1990 | Amemiya et al. | 355/274 |
| 4,914,737 | 4/1990 | Amemiya et al. | 355/276 |
| 4,935,776 | 6/1990 | Fukui | 355/206 |
| 5,182,603 | 1/1993 | Yamada | 355/273 |

FOREIGN PATENT DOCUMENTS

| | | |
|---|---|---|
| 0298505 | 1/1989 | European Pat. Off. . |
| 0298506 | 1/1989 | European Pat. Off. . |
| 61-117581 | 6/1986 | Japan . |
| 62-187869 | 8/1987 | Japan . |
| 62-191863 | 8/1987 | Japan . |
| 62-287271 | 12/1987 | Japan . |
| 1-015778 | 1/1989 | Japan . |
| 1-015777 | 1/1989 | Japan . |
| 64-43367 | 2/1989 | Japan . |
| 1-082077 | 3/1989 | Japan . |
| 1-257885 | 10/1989 | Japan . |
| 2-013977 | 1/1990 | Japan . |
| 2156598 | 10/1985 | United Kingdom . |

OTHER PUBLICATIONS

European Search Report (Dated Mar. 18).

*Primary Examiner*—Matthew S. Smith
*Attorney, Agent, or Firm*—Fitzpatrick, Cella, Harper & Scinto

[57] ABSTRACT

An image forming apparatus comprises a photoconductor on which a toner image is formed, an intermediate transfer drum disposed opposite to the photoconductor for holding a sheet on its circumferential surface, and a transfer charger disposed opposite to the photoconductor through the intermediate transfer drum for transferring a toner image from the photoconductor onto a sheet held on the intermediate transfer drum. A separation charger is disposed at a downstream side of the transfer charger in the rotational direction of the intermediate transfer drum for separating the sheet from the intermediate transfer drum, the output of the separation charger being set corresponding to the number of times the toner image is transferred.

15 Claims, 8 Drawing Sheets

SEPARATION CHARGER CONTROL FOR ELECTRO-PHOTOGRAPHIC APPARATUS

This is a division of U.S. patent application Ser. No. 182,515 filed Jan. 14, 1994, which is a continuation of U.S. patent application Ser. No. 07/963,262 filed Oct. 19, 1992, now abandoned which is a continuation of U.S. patent application Ser. No. 07/531,154 filed May 31, 1991, now abandoned.

FIELD OF THE INVENTION AND RELATED ART

The present invention relates to an image forming apparatus, and more particularly to an image forming apparatus wherein a toner image formed on an image bearing member through an electrophotographic or electrostatic recording process is transferred onto a transfer material supported on a transfer material carrying means. Examples of such image forming apparatuses include monochromatic or full-color electrophotographic copying machines, printers and other recording machines.

Various multi-color (full-color, for example) image forming machines have been proposed.

Referring to FIG. 4, there is shown a typical full-color electrophotographic copying apparatus which is provided with a so-called rotary type developing apparatus.

The copying machine includes an image bearing member in the form of a photosensitive drum 1 supported for rotation in the direction indicated by an arrow, and various image forming means are disposed around the outer periphery thereof. The image forming means may be of any type. In the example, it comprises a primary charger 2 for uniformly charging the photosensitive photosensitive drum 1 a color-separated light image or a light image corresponding thereto, in the form of a laser beam exposure means, for example, and a rotary type developing apparatus 4 for visualizing the electrostatic latent image on the photosensitive drum 1.

The rotary type developing apparatus 4 comprises developing devices 4Y, 4M, 4C and 4BK for respectively containing yellow color developer, a magenta color developer, cyan color developer and black color developer. It further comprises a generally cylindrical frame for rotatably supporting the four developing devices 4Y, 4M, 4C and 4BK The rotary type developing apparatus 4 presents a desired one of the developing devices to a position where it is faced to the outer periphery of the photosensitive drum 1, by rotation thereof, and the electrostatic latent image on the photosensitive drum 1 is developed by the presented developing device. When the frame 1 rotates through one full-turn, the full-color development is carried out in four colors.

The visualized image, that is, the toner image on the photosensitive drum 1 is transferred onto a transfer material P fed to the image transfer device 5. In this example, the transfer device 5 is in the form of a transfer drum rotatably supported.

As shown in FIG. 5, the transfer drum 5 includes a cylinder 5*a*, a transfer charger 5*b* disposed therein and a transfer material gripper 5*c* for gripping the transfer material fed from an unshown sheet feeding device.

At the inside and the outside of the transfer drum 5, an inside discharging charger 5*d* and an outside discharging charger 5*e* which constitute a discharging means, are disposed, respectively. In the opening of the cylinder 5*a*, a transfer material carrying member 501 is stretched. The transfer material carrying member 501 is usually in the form of a dielectric sheet or film and may be polyethylene terephthalate or polyvinylidene fluoride resin.

The full-color image forming process steps will be briefly described in the full-color electrophotographic copying apparatus having the structure described above.

The charger 2 and the image exposure means 3 are operated, by which a blue component electrostatic latent image is formed on the outer surface of the photosensitive drum, and the electrostatic latent image is developed with a yellow developer contained in the developing device 4Y.

On the other hand, the transfer material supplied to the transfer drum 5 is gripped by the gripper 5*c*, and is contacted to the toner image formed on the outer surface of the photosensitive drum 1 together with the rotation of the transfer drum 5. The toner image is transferred onto the transfer material by the operation of the transfer charger 5*b* and simultaneously, the transfer material is attracted to and retained on the transfer material carrying member 501.

These image forming and image transfer operations are repeated for the magenta, cyan and black color components. When the visualized images in the four colors are superposedly transferred onto the transfer material P, the transfer material P is electrically charged by the inside charger 5*d* and the outside charger 5*e*. Thereafter, the transfer material P is separated from the transfer drum 5 and is conveyed to a heat roller fixing device 5 which fuses and mixes the color toners to fix the image. Then, the transfer material P is discharged outside the apparatus. On the other hand, the toner remaining on the photosensitive drum is removed by the cleaner 7 and the photosensitive drum is subjected to the next image forming process.

The electrophotographic copying machine having such a structure is operated in very good order. However, the inventors' experiments and investigations have revealed that the image transfer process involves a problem when the transfer material carrying member 501 of the transfer device 5 is made of polyvinylidene fluoride resin film or the like with the use of image transfer paper as the transfer material P and particularly when the humidity is low. The description will be made as to this point.

As will be understood from FIG. 6, the discharging means for-electrically discharging the transfer material P onto which the toner image has been transferred usually comprises the inside discharging corona charger 5*d* in the form of an AC charger to which a DC bias is applied and an outside discharging corona charger 5*e* in the form of an AC charger.

Referring to FIG. 8, there is shown a sequence of the operation of the image forming apparatus. The inside charger 5*d* and the outside charger 5*e* are operated only during a so-called prerotation which is the rotation of the image bearing member before the image formation process of the image forming apparatus is started (the number of drum rotations is 3 and 4) and during the period from the start of the image formation process for the last color separated image, through the separation of the transfer material from the transfer drum to the end of the image formation process (the number of photosensitive drum rotations is 10, 11 and 12).

The polarity of the transfer voltage supplied to the transfer charger 5*b* is, for example, positive, when the latent image is formed with negative electric charge, and the toner of the developer is negatively charged.

The experiments and investigations have revealed that when the inside charger 5*d* and the outside charger 5*e* are operated (number of photosensitive drum rotations is 10–12)

after completion of the image transfer operation under a low humidity ambient condition, the toner is scattered from the transfer material P with the result of contamination of the shield of the outside charger 5*e*. When the quantity of the scattered toner is large, the image on the transfer material is disturbed, so that the image quality is degraded.

The problem of the toner scattering has been further investigated, and it has been found that the toner scattering tends to occur upon the electric discharging operation effected prior to separation of the transfer material from the transfer drum (particularly when the DC bias supplied to the inside charger 5*d* is large) after the toner image is transferred from the photosensitive drum with a relatively large transfer current under the low humidity condition.

FIG. 7 illustrates the mechanism of the toner scattering. The DC component supplied to the inside charger 5*d* has a polarity opposite to that of the voltage applied to the transfer charger in order to remove the electric charge from the transfer material carrying member 501 prior to a subsequent image transfer operation during a continuous copying mode operation. Under the low humidity condition in which the image transfer operation is carried out with a larger transfer current, it is required that the DC component current supplied for the electric discharge also increase. If the electric charge having the same polarity as that of the toner is deposited by the inside charger 5*d* on such a side of the transfer material carrying member 501 as is near the transfer charger 5*d*, the electric field produced by the electric charge repels the toner particles having the same polarity, so that the toner particles are separated from the transfer material.

The reason why the transfer current is to be increased under the low humidity condition is that the resistivity of the transfer material P is high and that under this condition, when the image transfer operations are to be repeated on the same transfer material as in the full-color image formation, the charge-up of the transfer material carrying member 501 and the transfer material P have to be compensated to assure the good image transfer operation.

As to the toner particles on the photosensitive drum, a relatively larger transfer current is required to attract the transfer material if the electric charge of the toner per unit volume of the toner particles is high. If the particle size of the toner used in the development is decreased, the electric charge of the toner applied in the developing device is increased. Therefore, with the use of small size toner particles suitable for improving the image quality, the above-described problems more easily arise.

The experiments and investigations by the inventors have shown that the tendency is increased when the average particle size of the toner is not more than 10 microns. Previously, the average particle size was usually 12 microns.

SUMMARY OF THE INVENTION

Accordingly, it is a principal object of the present invention to provide an image forming apparatus wherein the toner on the transfer material is prevented from scattering when the transfer material is separated from the transfer material carrying means, and wherein the resultant image degradation is prevented.

It is another object of the present invention to provide an image forming apparatus capable of forming good images irrespective of the ambient conditions such as humidity or the like.

It is a further object of the present invention to provide an image forming apparatus wherein the toner scattering is effectively prevented even when small particle size toner is used for the purpose of improving the image quality, and wherein good transferred images can be provided.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in conjunction with the accompanying drawings.

Figure 4:
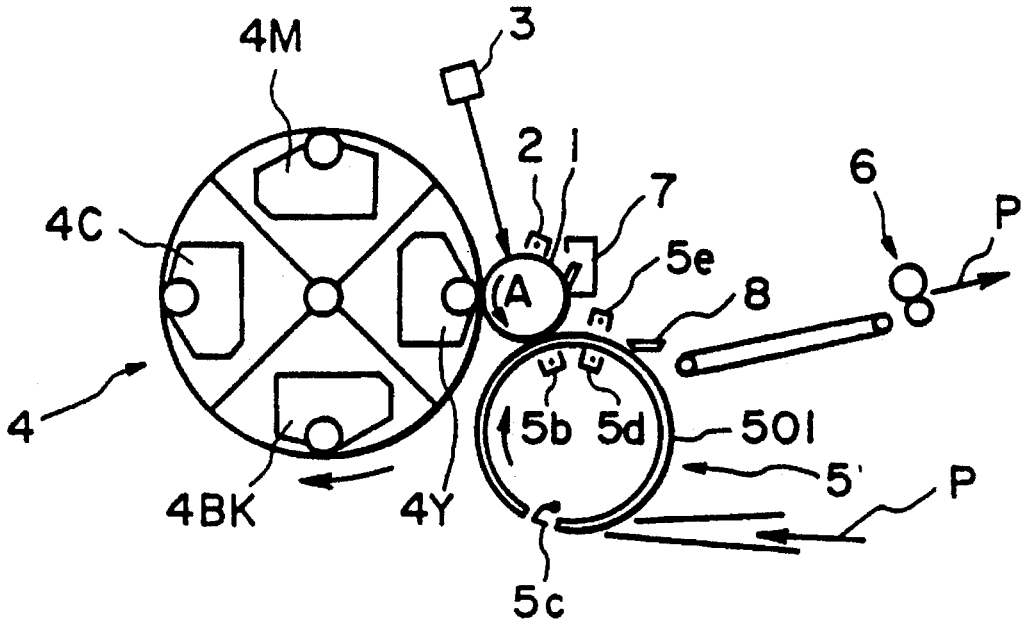
FIG. 4 is a sectional view of a multi-color electrophotographic copying apparatus according to an embodiment of the present invention.

The present invention is suitably usable with the multi-color electrophotographic copying apparatus including a rotary type developing device, described with FIG. 4. Therefore, the structure of the image forming apparatus in the portions not described in the following are similar to that of the FIG. 4 apparatus. In this embodiment, the diameter of the photosensitive drum 1 is 80 mm, for example; and the image transfer drum 5 of the transfer device has a diameter of 160 mm (twice the diameter of the photosensitive drum, for example).

The photosensitive drum is rotated in the direction A at a peripheral speed of 160 mm/sec, and the surface of the photosensitive drum is charged by the primary charger 2 to −500—500 V. The charged photosensitive drum 1 is exposed to an image modulated laser beam by an exposure means 3 such as a laser beam scanner, and the potential of the portion to receive the toner is attenuated down to −50—200 V, so that a latent image is formed.

Each of the developing devices of the rotary type developing apparatus 4 contains various color toner particles charged to a negative polarity, and therefore, it visualize the latent image into a toner image on the photosensitive drum 1 through a reverse development.

Figure 1:
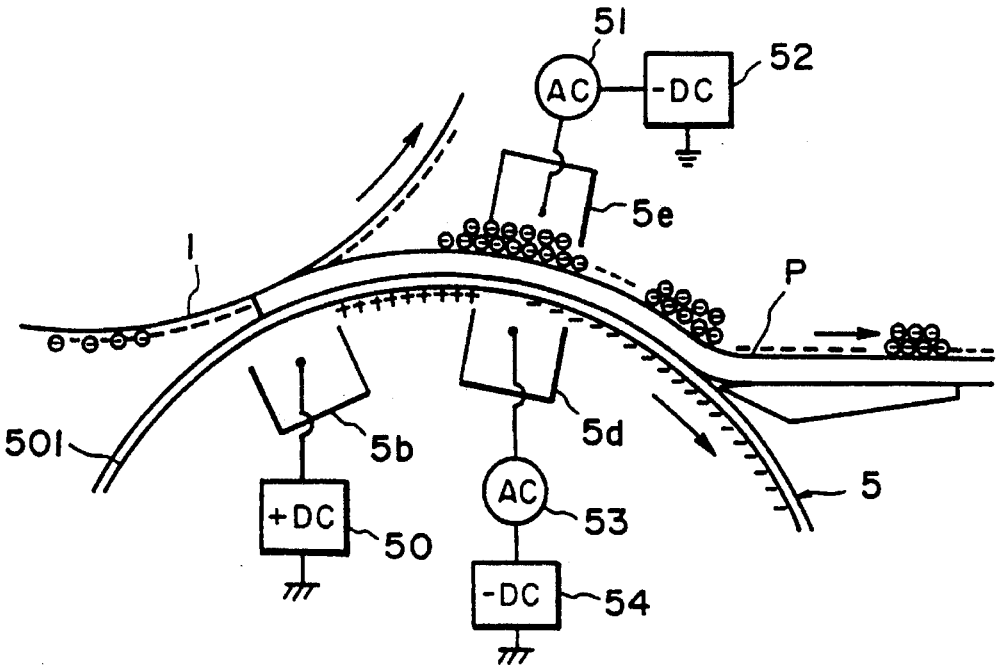
FIG. 1 is a sectional view of an image transfer device usable with an image forming apparatus according to an embodiment of the present invention.

Referring now to FIG. 1, which shows an embodiment of the present invention, the visualized image, that is, the toner image is transferred from the photosensitive drum 1 to a transfer material P carried to the transfer device 5.

Figure 5:
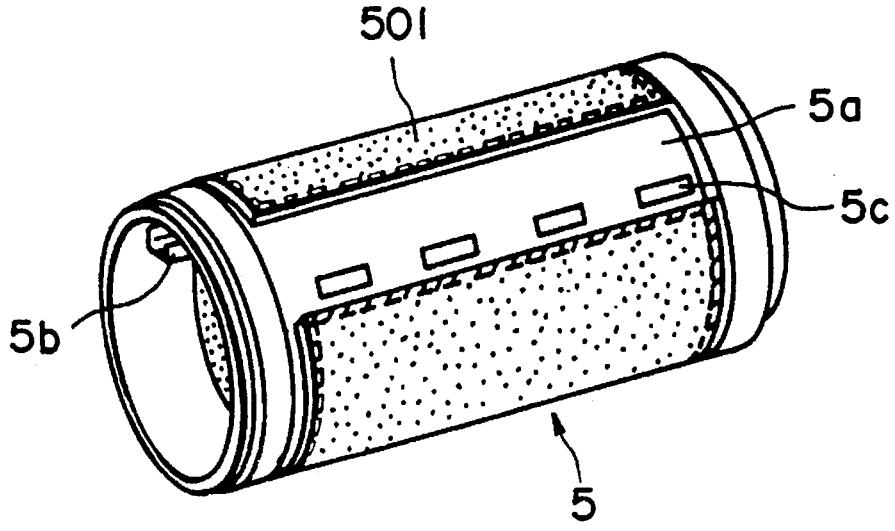
FIG. 5 is a perspective view of an image transfer device used in the image forming apparatus of FIG. 4.
Figure 6:
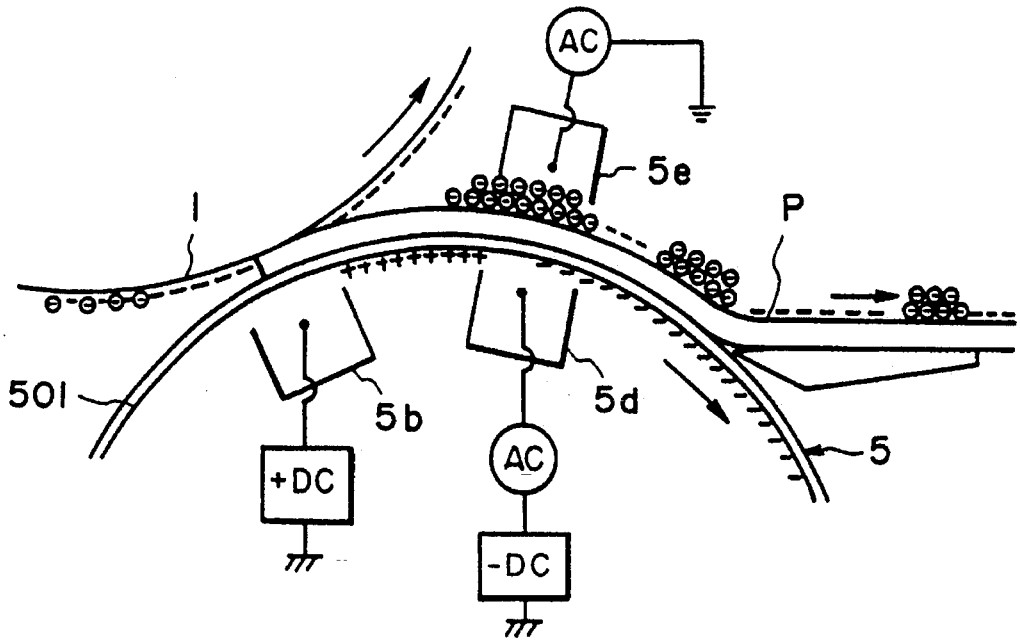
FIG. 6 is a sectional view of an image transfer device not incorporating the present invention.
Figure 7:
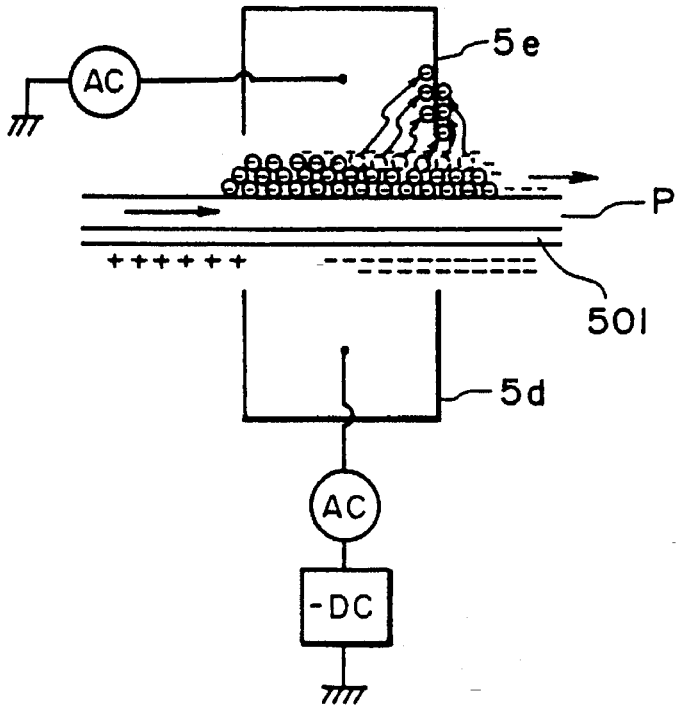
FIG. 7 is a schematic view illustrating the behavior of the toner scattering in the device of FIG. 6.
Figure 8:
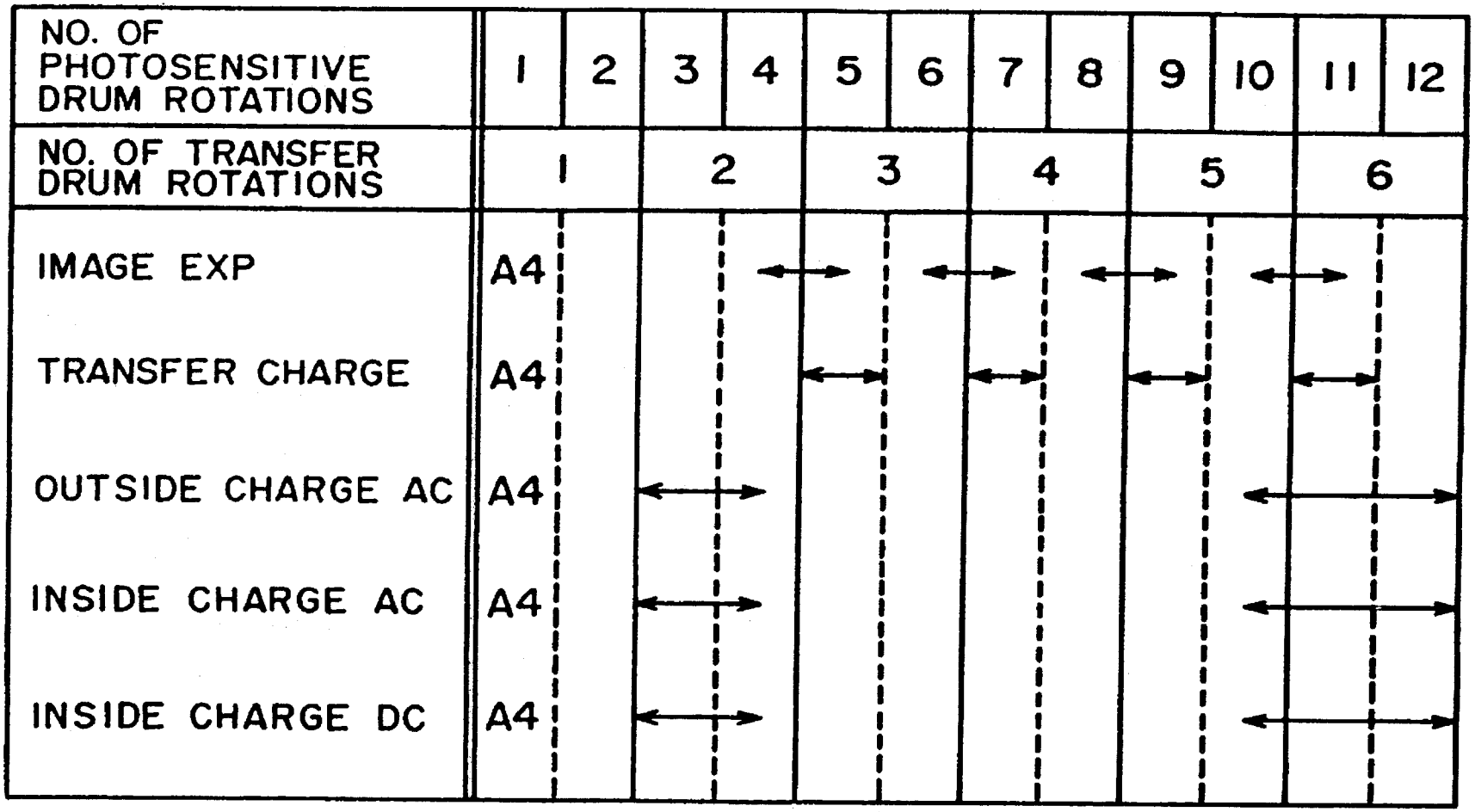
FIG. 8 shows a sequence of operation of an image forming apparatus not incorporating the present invention.

The transfer device 5 in this embodiment has a structure similar to that of FIG. 5. The transfer device includes a transfer drum rotatably supported, which includes a cylinder 5*a* having two opposite ring portions, connecting portions for connecting the rings and a cut-away portion without them, a transfer material carrying member 501 stretched in the cut-away portion of the cylinder 5*a*, a transfer charger 5*b* disposed in the transfer drum 5, and a transfer material gripper 5, disposed on the connecting portion, for gripping the transfer material P supplied from a sheet feeding device (not shown). At the inside and outside of the transfer drum 5, there are disposed an inside discharging charger 5*d* and an outside discharging charger 5*e* which constitute discharging means, respectively.

The transfer material carrying means 501 is in the form of a dielectric sheet made of polyvinylidene fluoride resin film having a thickness of 10–175 microns and a volume resistance of $10^{13}$ ohm.cm, for example. The usable dielectric sheet has a volume resistivity of not less than 108 ohm.cm.

As will be understood from FIG. 1, the transfer charger 5*b* is a corona charger having a wire electrode and a shield electrode enclosing it. To the wire electrode, a voltage of +6 KV–+9 KV is applied from a DC source 50 to provide the transfer current of +100–+500 micro-amperes.

Figure 2:
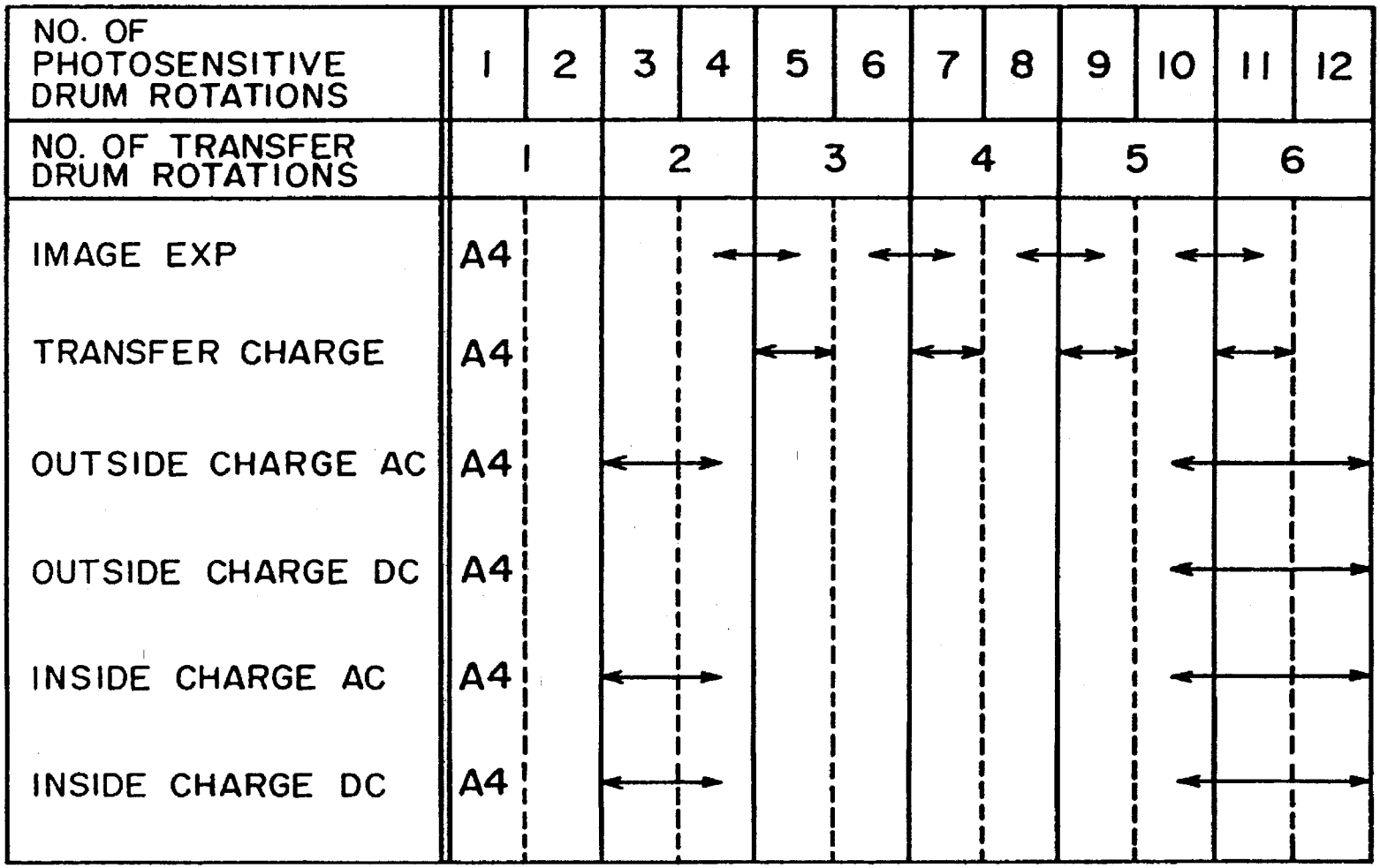
FIG. 2 shows an operational sequence of the transfer device and discharging means relative to the number of revolutions of the photosensitive drum and the transfer drum in the apparatus of FIG. 1.

There is provided discharging means for discharging a transfer material having received the toner image at a position downstream of an image transfer position where the transfer charger is faced to the photosensitive drum 1 and upstream of a separating position where the transfer material P is separated from the transfer material carrying member 501, with respect to the movement direction of the periphery of the transfer drum 5. The discharging means comprises an inside discharging corona charger 5*d* and an outside discharging corona charger 5*e*. The inside discharging corona charger 5*d* is an AC charger (12 KVDp and 800 micro-amperes) to which a DC bias is added or superimposed (−0.7—3.7 KV and −50—265 micro-amperes) upon an AC oscillation from an AC source 53 and a DC source 54. The outside discharging corona charger 5*e* is an AC corona charger (8 KV and 600 micro-amperes) to which a DC bias is added or superimposed (−0.2—1.0 KV and −10—50 micro-amperes) upon an AC oscillation, by an AC source 51 and a DC source 52. The phases of the AC components by the outside charger 5*d* and the inside charger 5*e* are controlled to be opposite, In this structure, the discharging means that is, a combination of the inside and outside chargers 5*d* and 5*e*, as shown in FIG. 2 (operational sequence), and as in the conventional image forming apparatus, is operated during the pre-rotation period before the start of the image forming process operation of the image forming apparatus (revolutions 3 and 4 of the photosensitive drum), and during a period from the start of the image formation process for the last color component image to the end of the image formation process after the transfer material is separated from the transfer drum (revolutions 10–12). In addition, the outside charger 5*e* of the discharging means is supplied with a negative DC (the same polarity as the toner) during a period from the image transfer of the last color component (the image transfer immediately before the separation) to the transfer material separating operation (revolutions 10–12 of the photosensitive drum). The outside charger 5*e* acts on the transfer material and on the transfer material carrying member.

According to this embodiment of the present invention, it is possible that the negative DC, that is, the DC having the polarity which is the same as the toner, applied to the outside charger 5*e* is effective to confine the toner on the transfer material when the inside and outside charger is operated.

Figure 3:
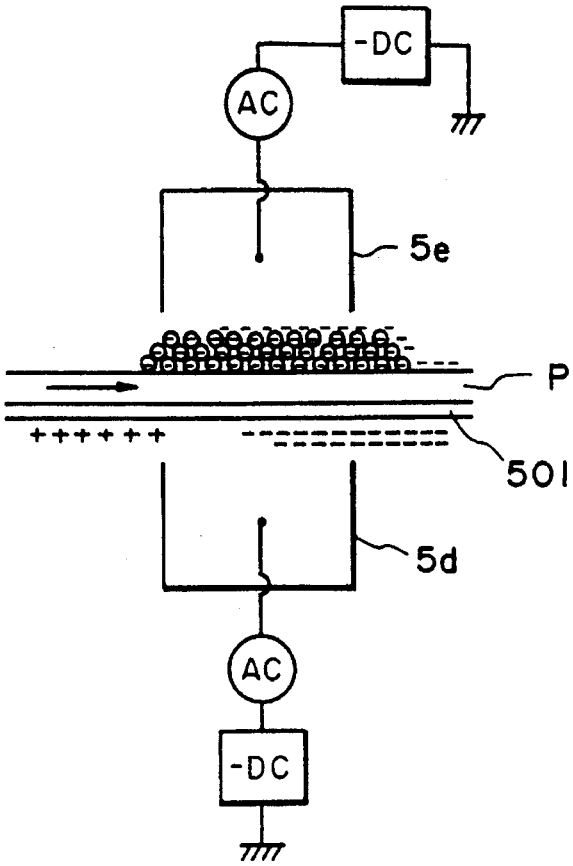
FIG. 3 is a somewhat schematic view illustrating the effect of the charging means.

FIG. 3 shows the principle.

The negative charge (the same polarity as the toner) applied to the toner on the transfer material P by the outside charger 5*e* is effective to suppress the amount of the negative charge deposited onto the transfer material carrying member 501 from the inside charger 5*d*, and therefore, effective to reduce the force to the toner in the direction separating from the transfer material. Therefore, the application of the negative charge to the toner is preferably such that it does not obstruct the discharging of the transfer material carrying member 501 positively charged by the transfer charger 5*b*.

In the embodiment, the DC bias to the outside charger 5*e* is preferably −25 micro-amperes (−0.6 KV) when the DC bias to the inside charger 5*d* during the AC application is −260 micro-ampere (−3.7 KV).

Various experiments and investigations by the inventors in the actually used conditions using the above embodiments, have concluded that it is preferable that the discharge current is larger under the low humidity condition, and it is small or zero under the high humidity condition. The reason why is considered as being that the large discharge current is desirable under the low humidity condition because the charge of the toner is increased, and that the large current is desirable when the transfer material carrying member and the transfer material are discharged upon the transfer material separation because the resistance of the transfer material and the transfer material carrying member is high.

On the other hand, under the high humidity condition, the discharging is easy, while on the other hand, if the discharge current is large, the electric charge having the same polarity as the toner reaches the transfer position from the outside through the transfer material, thus weakening the transfer electric field, and therefore, incomplete image transfer occurs.

Figure 10:
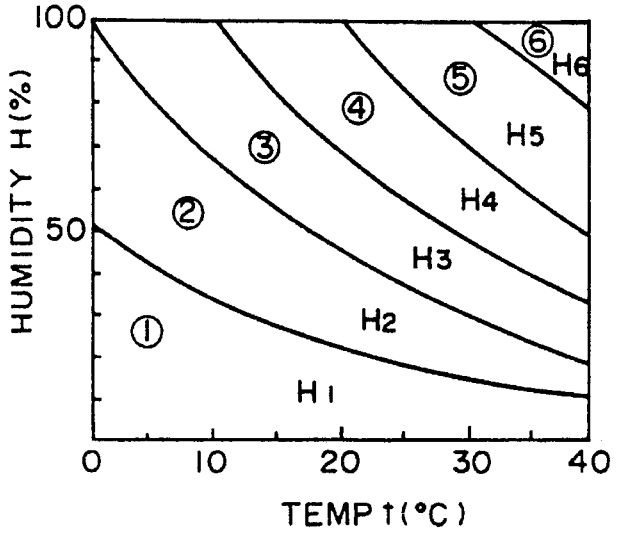
FIG. 10 illustrates constant water content regions in the air on the graph of humidity vs. temperature.
Figure 11:
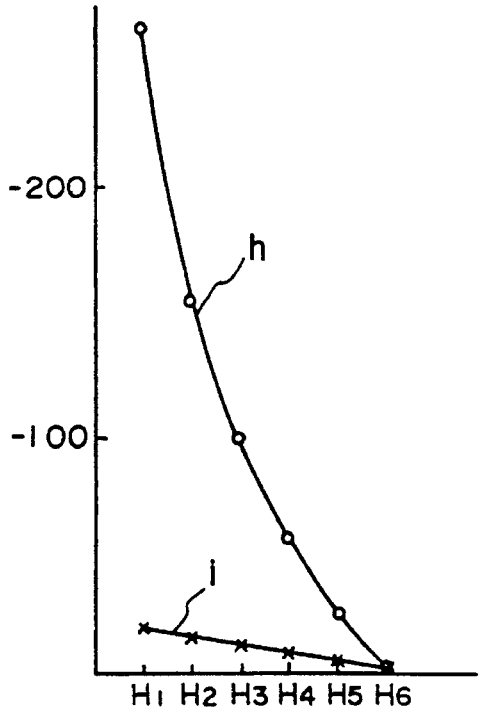
FIG. 11 is a graph of DC component applied to the discharging current vs. the water content in the air.

FIGS. 10 and 11 show a relation between the humidity and the currents of the inside and outside chargers. FIG. 10 shows the relation between the humidity of the ambience and the temperature, and FIG. 11 shows the optimum DC current applied during the operations of the inside and outside dischargers in each of the zones H1–H6. In each of the zones H1–H6, the water content in the air shown in FIG. 10 is substantially constant. In the Figure, reference character h is the DC current supplied to the inside charger, and reference character i is the DC current applied to the outside charger.

The inventors have further investigated a the relation between the particle size of the toner of the toner image on the photosensitive drum 1 and the amount of the toner particles scattered away from the transfer material. The results of experiments are shown in FIG. 9.

In the experiments, the amount of the scattered toner is determined on the basis of the weight of the toner particles deposited on the outside charger 5*e*, and the comparison is made on the basis of the amount thereof after 1000 sheets (A4 size) having the same image is processed. The image has 30% by area of each of the yellow, magenta, cyan and black portions.

Figure 9:
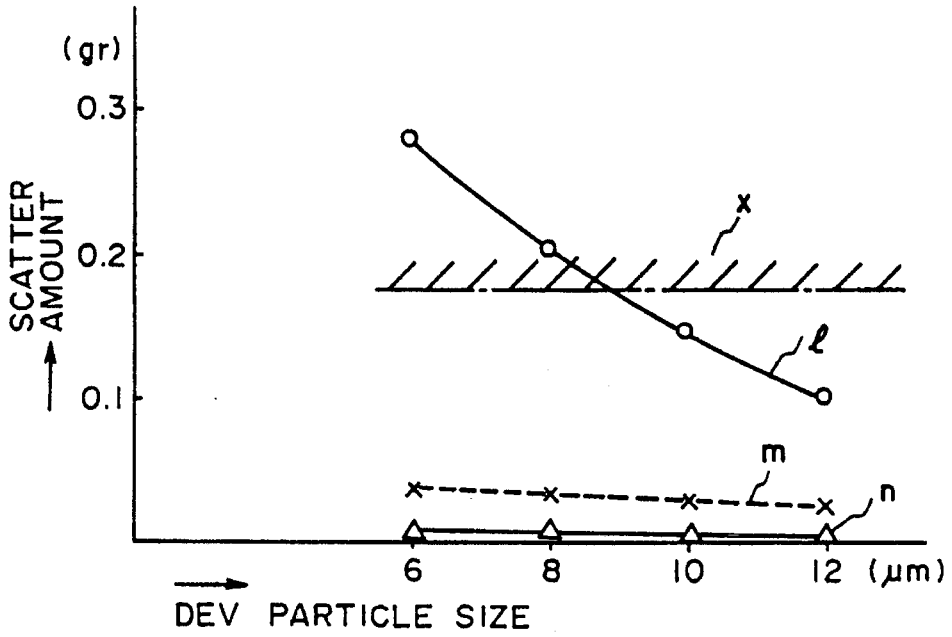
FIG. 9 is a graph of the amount of toner scattered vs. toner particle size, illustrating the effects of the present invention.

A reference character l in FIG. 9 designates an amount of scattered toner in the conventional apparatus, and a reference character m designates the amount of scattered toner in the embodiment of the present invention. When the amount of the toner deposited is at the level indicated by a reference character X, the shield of the outside charger 5*e* is contaminated with the result of the non-uniform discharge at the discharging operation, and therefore, the discharging of the transfer material carrying member upon the pre-rotation (revolutions 3 and 4 of the photosensitive drum) is also non-uniform with the result of improper image formations.

When the particle size of the toner is reduced, the amount of the scattered toner is increased for the following reasons. The thickness of the toner layer on the transfer material is smaller when the particle size of the toner is small, and the total amount of charge is substantially the same as in the case of the larger particle toner, but they are closer to the discharging charge (the charge having the same polarity as the toner) on the backside of the transfer material carrying member, and therefore, the repelling force is increased.

Accordingly, when the toner having the average particle size of not more than 10 microns is used, the toner scattering which may occur upon the low humidity condition when the average particle size is larger than 10 microns, more easily occurs under the usual conditions.

As described in the foregoing, the transfer device includes the discharging means for discharging the transfer material from the transfer material carrying member, disposed at a position between an image transfer position where the toner image is transferred from the image bearing member to the transfer material and a separation position where the transfer material is separated from the transfer material carrying member. The discharging means also includes the discharging charger, disposed at the transfer material side, for effecting alternating electric discharge in the positive and negative directions biased toward the same polarity as the toner during the transfer operation, and a discharging charger, disposed at the transfer material carrying member side, for effecting alternating electric discharge in the positive and negative directions biased toward the same polarity as the toner on the transfer material. The discharging means acts on the transfer material from the image transfer operation immediately before the transfer material separating operation to the transfer material separation operation. That is, the discharging means acts on the entirety of the transfer material in the moving direction.

According to this embodiment, it can be avoided that the toner on the transfer material is scattered upon the transfer material separating operation under the low humidity conditions with the result of image deterioration. Even when the small particle size toner is used to improve the image quality, the toner scattering which tends to occur not only in the low humidity conditions can be prevented, so that good quality images can be provided.

Figure 12:
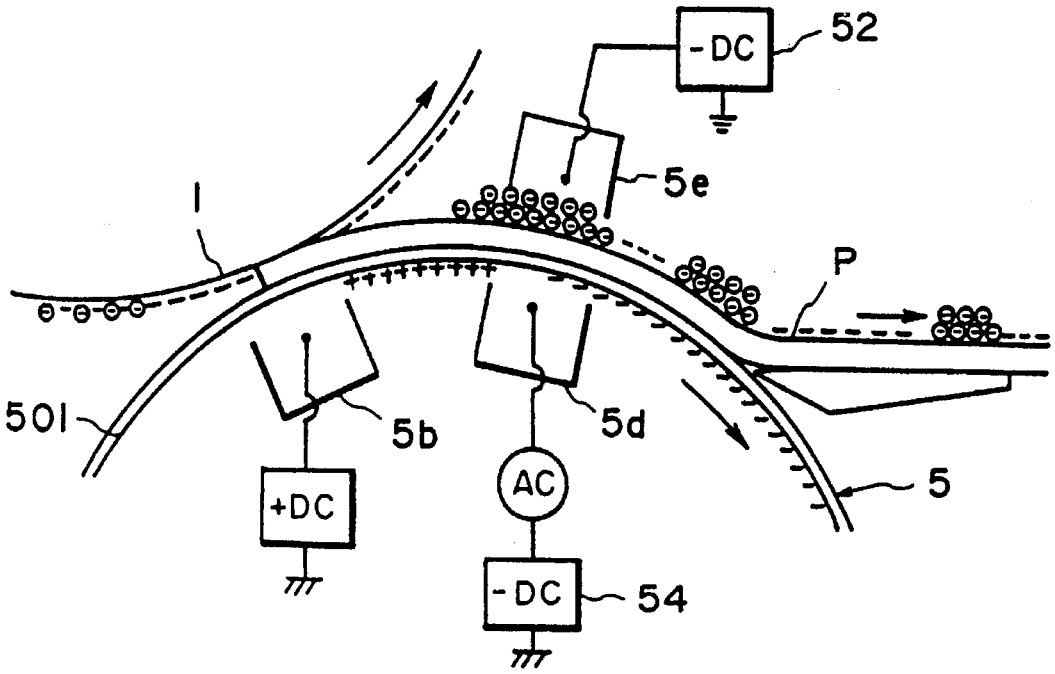
FIG. 12 is a sectional view of a transfer device according to another embodiment of the present invention.

In this embodiment, as shown in FIG. 1, the discharging chargers 5*d* and 5*e* are supplied with an AC voltage biased with a DC voltage having the same polarity as the toner upon the image transfer operation, that is, DC biased AC voltage is applied. As shown in FIG. 12, however, only the DC voltage having the same polarity as the toner upon the transfer operation may be applied thereto. The operational timing of the discharging charger is as shown in FIG. 2. By doing so, the structure is simpler than the foregoing embodiment. However, when a relatively small DC current such as several tens—several hundreds micro-amperes flows through the discharging charger, the current tends to be unstable. Therefore, it is preferable that the DC biased AC voltage is supplied to the discharging charger, and the control is made so as to provide a constant current difference, as shown in FIG. 1.

Another example of the discharging charger usable with the image forming apparatus of this embodiment is discussed below.

Figure 13:
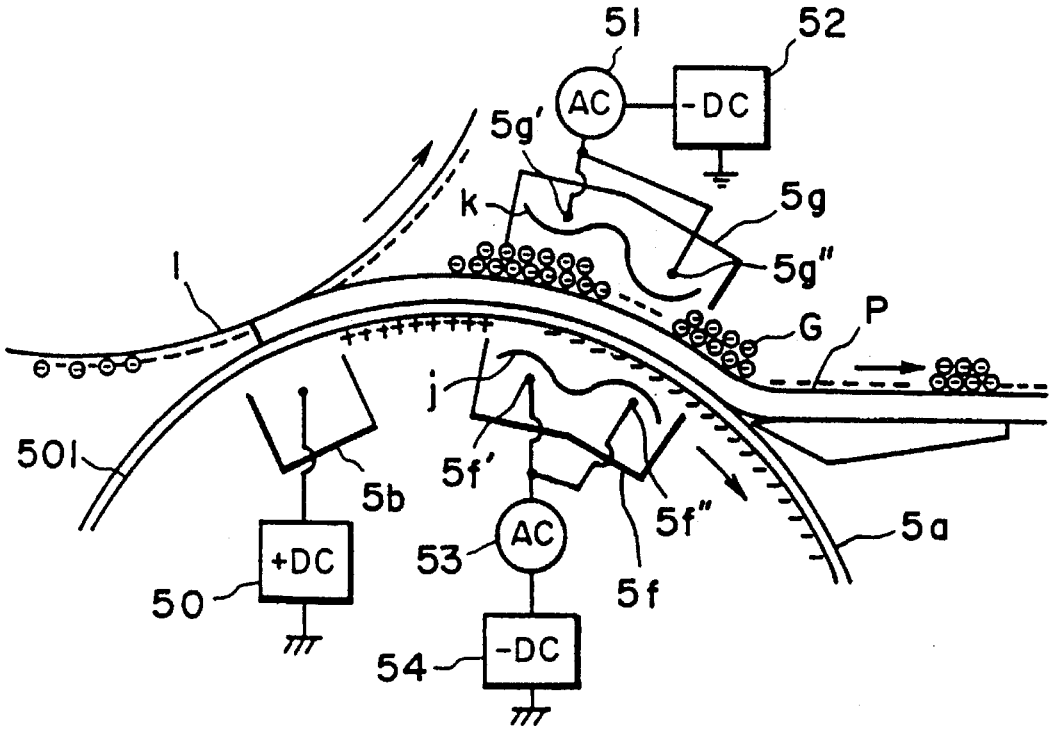
FIG. 13 is a sectional view of an image transfer device according to a further embodiment of the present invention.
Figure 14:
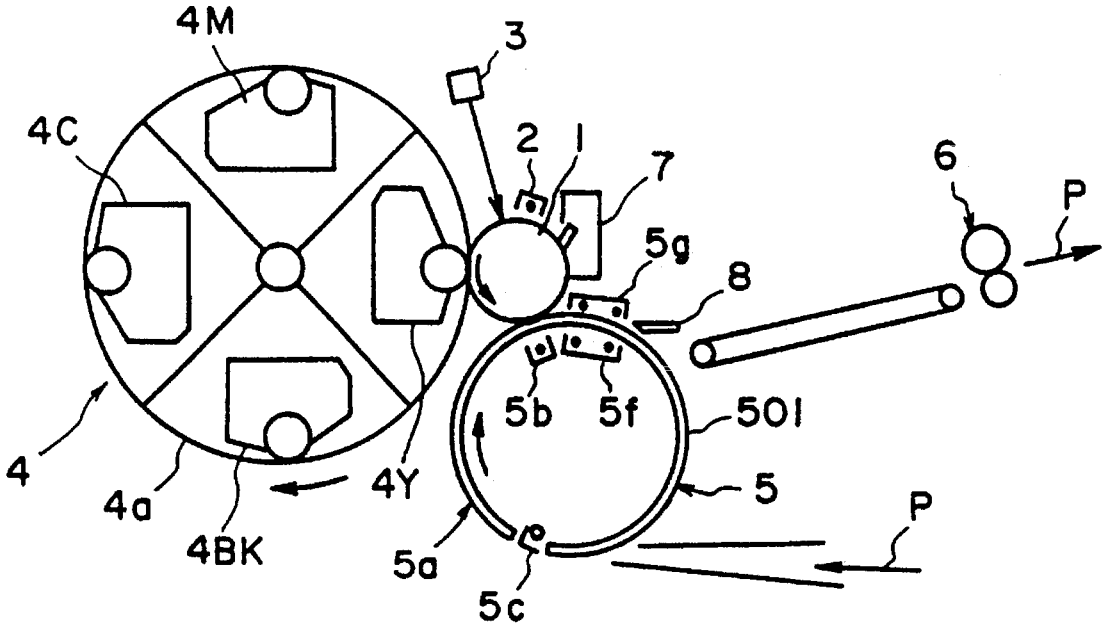
FIG. 14 is a sectional view of a multi-color electrophotographic apparatus to which the present invention can be incorporated.

FIGS. 13 and 14 show the discharging charger of this embodiment. The structures of the parts other than the discharging charger is the same as in the foregoing embodiment.

Discharging means 5*f* is connected with an AC voltage source 53 and a DC voltage source 54. A discharging means 5*g* is connected with an AC voltage source 51 and a DC voltage source 52. The discharging means 5f effects the corona discharge of the polarity opposite to that of the transfer charger 5*b*. That is, the discharging means are supplied with a voltage having a DC component of the polarity opposite to the polarity of the toner upon the image transfer. The discharging means 5*f* and 5*g* are disposed across the transfer material carrying member 501 and the transfer material P from each other, that is, at the inside and outside of the transfer material 5 as if they sandwich the transfer drum 5, at a position downstream of the transfer charger 5*b* with respect to the movement direction of the transfer drum 5. As shown in FIG. 13, the discharging means 5*f* and 5*g* have plural discharging portions (discharging electrodes) 5*f*, 5*f*", 5*g*' and 5*g*" arranged along the movement direction of the transfer drum 5. The distances from the upstream discharging portions 5*f*' and 5*g*' to the transfer material P or to the transfer material carrying member 501 are larger than those of the downstream discharging portions 5*f*" and 5*g*".

The discharging means 5*f* is an AC charger (12 KVpp and 800 micro-ampere) to which a DC bias (–0.7– –3.7 KV and –50—265 micro-amperes) is applicable upon an AC oscillation. The discharging means 5*g* is an AC charger (8 kV and 600 micro-amperes) to which a DC bias (–0.2—1.0 KV and –10—50 micro-amperes) is applicable upon the AC oscillation. The phases of the AC components of the discharging means 5*f* and 5*g* are controlled to the opposite.

The discharging means 5*f* and 5*g*, similarly to the case of FIG. 2, are operated during the prerotation (revolutions 3 and 4 of the photosensitive drum 1) before the start of the image formation process and during a period from the start of the last color separation means forming process to the completion of the image forming process after the separation of the transfer material P from the transfer drum 5 (revolutions 10–12 of the photosensitive drum 1). They act on the transfer material P from the image transfer operation immediately before the transfer material separation to the end of the transfer material separating operation. As a result of the negative DC voltage application of the same polarity as the toner upon the transfer operation to the discharging means 5*g*, the electric field is applied in the direction of confining the toner to the transfer material P, so that the toner is prevented from scattering.

During the operation, the current distribution of the upstream discharging portions 5f' and 5g' of the discharging means 5f and 5g are weak as shown by chain lines j and k, in FIG. 13, but the distribution by the discharging portions 5f" and 5g" is stronger. Therefore, the toner G having the negative polarity on the transfer material is gradually discharged electrically, and therefore, they are not scattered, and are fixed on the transfer material P as it is by the fixing device 6. Accordingly, the toner is not deposited on the shield of the discharging means 5g (contamination), or the improper transfer image is not produced.

The surface potentials of the transfer material P and the carrying member 501 after the discharging operation were measured and were confirmed as being equivalent. In addition, the image transfer efficiency after the continuous image transfer are the same as the case of the conventional discharging means.

The application of the negative charge to the toner is desired to be such an extent that the electric discharge of the carrying member 501 charged by the transfer is not obstructed. In this embodiment, the DC bias of –25 micro-amperes (–0.6 KV) applied to the discharging means 5g was optimum when the DC bias upon the AC application to the inside discharging means 5f was –265 micro-ampere (–3.7 KV).

FIG. 9 shows (n) a relation between the toner particle size and amount of the scattered toner in the embodiment of FIG. 13, similar to the embodiment of FIG. 1. In the present embodiment, it is easily understood that the amount of the scattered toner is smaller than in the foregoing embodiment.

In the embodiments, the discharging means 5f and 5g have two discharging portions, respectively. However, the number may be three or more.

In the embodiments, the electric current supplied to the transfer charger 5b to transfer the toner image from the photosensitive drum to the transfer material P is set as shown in Table 1 in the case of the toner being negatively charged.

TABLE

| Transfer | Humidity | | |
|---|---|---|---|
| current | 20% | 50% | 80% |
| 1st color T1 | 275 uA | 175 uA | 100 uA |
| 2nd color T2 | 375 | 225 | 125 |
| 3rd color T3 | 425 | 275 | 150 |
| 4th color T4 | 475 | 325 | 175 |

As a result of the experiments and investigations by the inventors, it has been found that if the inside charger 5d and the outside charger 5e are operated after the completion of the image transfer under the low humidity condition (revolutions 10–12 of the photosensitive drum in FIG. 2), the toner on the toner material P is easily scattered.

Further investigations of the toner scattering by the inventors have concluded that the toner scattering easily occurs if the transfer current for transferring the toner image from the photosensitive drum is increased under the low humidity conditions, and after the image transfer, the DC component added particularly to the inside charger 5d upon the discharging operation prior to the separation of the transfer material from the transfer drum is strong.

Further, when single color, two color, three color and four color copying operations are performed with a constant DC component, the amount of the scattered toner is larger if the number of transfer operations is smaller.

When the voltage applied to the discharging means is changed in accordance with the number of transfer operations, the toner scattering can be prevented.

Here, the voltage applied to the discharging charger disposed at a side of the transfer material carrying member, opposite from the side carrying the transfer material, is preferably increased with the number of superposing toner transfer operations onto the transfer material, and the discharging charger at the transfer material carrying side preferably effects the alternating positive and negative discharge biased toward the same polarity as the toner.

The transfer material carrying member is preferably made of a dielectric sheet or film. The discharging means preferably effects stronger discharge of the same polarity as the toner polarity under the low humidity conditions, whereas under the high humidity conditions the-discharge of the same polarity as the toner is decreased.

This will be described in conjunction with FIG. 1, but it is similarly applicable to the discharging means of FIGS. 12 and 13. The operational timing of the inside charger and the outside charger which constitute the discharging means is the same as described in conjunction with FIG. 2. The discharging means acts on the transfer material during the time period from the transfer immediately before the separation to the separation.

The inventors have investigated the above-described structure under actual operating conditions. It has been found that it is preferable that the discharging current is made larger under the low humidity conditions, and the discharging current is made smaller or made zero under the high humidity conditions. Under the low humidity conditions, the DC component applied to the inside discharging charger is –260 micro-amperes (–3.7 kV) in the case of four color transfer. If, however, the copies which are only in a single color, only in two colors or only in three colors, the toner is easily scattered because the DC component is too much.

Figure 15:
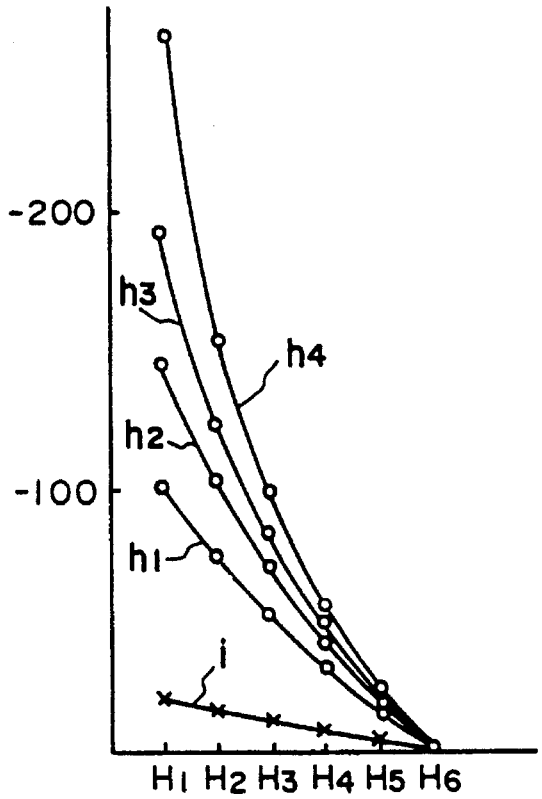
FIG. 15 is a graph of a DC component applied to the discharge current vs. the water content in the air.

FIG. 15 shows the relation between the humidity and the currents through the inside and outside chargers in this embodiment. In FIG. 15, in each of the zones H1–H7, the water content contained in the air shown in FIG. 10 is constant. FIG. 15 shows the optimum DC current to be applied to the inside and outside dischargers in each of the zones. In the Figure, the reference $h_j$ (J=1–4) indicates the DC component applied to the inside charger, and the reference i indicates the DC component applied to the outside charger.

Assuming that the transfer current for the first color is T1, for the second color is T2, for the third color is T3 and for the fourth color is T4 under each of the humidity conditions H1–H7, the curve $h_j$ (J=1–4) indicative of the DC component applied to the inside discharger indicates that when a single color image formation is performed on the transfer material, the transfer current T1 is used, and the DC component indicated by h1 is applied. Therefore, h4 shows the DC component applied during the separating operation after the four color images are transferred with the transfer currents T1, T2, T3 and T4.

The following Table 2 shows a DC bias applied to the inside charger shown in FIG. 15.

TABLE 2

| | H1 | H2 | H3 | H4 | H5 | H6 |
|---|---|---|---|---|---|---|
| h1 | 100 | 75 | 50 | 30 | 17 | 0 |
| h2 | 150 | 105 | 70 | 40 | 20 | 0 |
| h3 | 200 | 130 | 80 | 50 | 23 | 0 |
| h4 | 265 | 160 | 100 | 55 | 25 | 0 |

(micro-ampere)

According to this embodiment, the amount of electric discharge from the transfer material and from the transfer material carrying member by the inside charger is decreased with the decrease of the number of transfer operations, by which the amount of scattered toner is reduced as compared with the case wherein the amount of discharge is not changed in accordance with the number of transfer operations. Therefore, the contamination of the outside charger *5e* and the non-uniform discharge upon the discharging operation can be prevented. It is also effective to the prevention of the toner scattering to decrease the amount of electric discharge by the outside charger with the decrease of the number of transfer operations.

According to this embodiment, the prevention of the toner scattering from the transfer material upon the transfer material separation and the resultant image deterioration can be prevented under the low humidity conditions irrespective of the number of transfer operations. Even when the small particle size toner (the average particle size of not more than 10 microns) for the purpose of improving the image quality, the toner scattering which easy occurs not only in the low humidity conditions can be effectively prevented, and therefore, the good quality of the image can be assured.

In the foregoing embodiments, the transfer material carrying means is in the form of an image transfer drum, but it is possible to use an image transfer belt.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a photoconductor;

means for forming a toner image on the photoconductor;

an intermediate transfer member disposed opposite to the photoconductor for holding a sheet on its circumferential surface;

a transfer charger disposed opposite to the photoconductor through the intermediate transfer member for transferring a toner image from the photoconductor onto a sheet held on the intermediate transfer member;

a separation charger disposed at a downstream side of the transfer charger in the rotational direction of the intermediate transfer member for separating the sheet from the intermediate transfer member; and means for setting an output of the separation charger corresponding to the number of times the toner image is transferred.

2. The image forming apparatus as defined in claim 1, wherein the setting means sets an output of the separation charger to an increasingly larger value as the number of times the toner image is transferred increases.

3. The image forming apparatus as defined in claim 1, further comprising means for correcting a value set by the setting means based on an ambient condition.

4. The image forming apparatus as defined in claim 1, further comprising means for correcting a value set by the setting means corresponding to a property of the sheet.

5. The image forming apparatus as defined in claim 1, further comprising means for increasing an output of the transfer charger every time the toner image is transferred.

6. An image forming apparatus, comprising:

a photoconductor;

means for forming a toner image on the photoconductor;

an intermediate transfer member disposed opposite to the photoconductor for holding a sheet on its circumferential surface;

a transfer charger disposed opposite to the photoconductor through the intermediate transfer member for transferring a toner image from the photoconductor onto a sheet held on the intermediate transfer member;

a separation charger disposed at a downstream side of the transfer charger in the rotational direction of the intermediate transfer member for separating the sheet from the intermediate transfer member;

means for recognizing the number of times the toner image is transferred; and means for setting an output of the separation charger corresponding to the number of times the toner image is transferred.

7. The image forming apparatus as defined in claim 6, wherein the setting means sets an output of the separation charger to an increasingly larger value as the number of times the toner image is transferred increases.

8. The image forming apparatus as defined in claim 6, further comprising:

means for detecting a state of surroundings; and means for correcting a value set by the setting means basing on an output received from a detecting means.

9. The image forming apparatus as defined in claim 6, further comprising:

means for judging a property of the sheet; and means for correcting a value set by the setting means corresponding to the result of the judgment.

10. The image forming apparatus as defined in claim 6, further comprising means for increasing an output of the transfer charger every time the toner image is transferred.

11. A method of forming an image on a sheet by electrostatically transferring a toner image formed on an image holding member onto a sheet held by a transfer member, comprising the steps of:

a) forming a toner image on the image holding member;

b) electrostatically transferring the toner image onto a sheet on the transfer member;

c) repeating steps a) and b) for a predetermined number of times for the same sheet; and d) removing electric charge on the transfer member by a charger, said charger output being varied based on the number of times steps a) and b) are repeated.

12. The method as defined in claim 11, wherein said output of the charger is varied over a larger range as the number of times steps a) and b) are repeated increases.

13. The method as defined in claim 12, further comprising the step of correcting the output of the charger based on an ambient condition.

14. The method as defined in claim 12, further comprising the steps of:

detecting a state of surroundings; and correcting the output of the charger based on the state of surroundings.

15. A method of forming a colored image on a sheet by electrostatically transferring a colored toner image formed on an image holding member onto a sheet held by a transfer member, comprising the steps of:

a) forming a toner image on the image holding member by using a toner selected from yellow toner, magenta toner, cyan toner and black toner;

b) electrostatically transferring the toner image onto the sheet on the transfer member;

c) changing the color of the toner in step a);

d) repeating steps a) and b) for a predetermined number of times with respect to the same sheet;

e) removing electric charge on the transfer member by a charger, said charger being varied based on the number of times steps a) and b) are repeated; and f) fixing the toner image onto the sheet after steps a)–e) are completed.

* * * * *

UNITED STATES PATENT AND TRADEMARK OFFICE

CERTIFICATE OF CORRECTION

PATENT NO. : 5,552,872 Page 1 of 2

DATED : September 3, 1996

INVENTOR(S) : KOJI AMEMIYA, ET AL.

It is certified that error appears in the above-indentified patent and that said Letters Patent is hereby corrected as shown below:

COLUMN 1:

Line 44, "4BK" should read --4BK.--.

COLUMN 2:

Line 42, "for-electrically" should read --for electrically--.

COLUMN 5:

Line 4, "-500— 500 V." should read -- -50 - - 500 V.--;

Line 7, "-50— 200 V," should read -- -50 - - 200 V,--.

Line 10, "it" should read --they--.--

UNITED STATES PATENT AND TRADEMARK OFFICE

CERTIFICATE OF CORRECTION

PATENT NO. : 5,552,872 Page 2 of 2

DATED : September 3, 1996

INVENTOR(S) : KOJI AMEMIYA, ET AL.

It is certified that error appears in the above-indentified patent and that said Letters Patent is hereby corrected as shown below:

COLUMN 6:

Line 65, "a" should be deleted.

COLUMN 10:

Line 18, "the-discharge" should read --the discharge--.

COLUMN 12:

Line 34, "basing" should read --based--.

Signed and Sealed this

Eighteenth Day of March, 1997

Bruce Lehman

*Attest:*

BRUCE LEHMAN

*Attesting Officer*

*Commissioner of Patents and Trademarks*